United States Patent [19]

Raymond

[11] 3,999,904

[45] Dec. 28, 1976

[54] ORBITAL PISTON ENGINE

[75] Inventor: Charles Raymond, Marshall, Calif.

[73] Assignee: Redskin Engines, Calif.

[22] Filed: July 28, 1975

[21] Appl. No.: 599,716

Related U.S. Application Data

[63] Continuation-in-part of Ser. No. 504,437, Sept. 9, 1974, abandoned.

[52] U.S. Cl. ..... 418/59

[51] Int. Cl.[2] ..... F04C 1/02

[58] Field of Search ..... 418/54, 55, 56, 59

[56] References Cited

UNITED STATES PATENTS

| | | | |
|---|---|---|---|
| 1,378,065 | 5/1921 | Varley | 418/59 |
| 1,560,624 | 11/1925 | Varley | 418/59 |
| 1,973,670 | 9/1934 | Star | 418/59 X |

FOREIGN PATENTS OR APPLICATIONS

| | | | |
|---|---|---|---|
| 1,160,774 | 8/1969 | United Kingdom | 418/59 |

*Primary Examiner*—C. J. Husar
*Assistant Examiner*—Leonard Smith
*Attorney, Agent, or Firm*—Flehr, Hohbach, Test

[57] ABSTRACT

An engine is disclosed in which a piston is mounted to orbit in a circular path within a working chamber for use as a fluid pump or motor. The working chamber includes a pair of juxtaposed cylindrical chambers which are interconnected by an arcuate chamber, with inlet and outlet ports opening into the cylindrical chambers. The walls of the cylindrical chambers are formed with recesses for preventing hydraulic lock-up and vacuum formation. The piston includes a pair of spaced-apart crank ends which carry an arcuate mid-span as the principal displacement element. A drive train conjointly moves the crank ends in circular paths within the cylindrical chambers which in turn gyrates the mid-span in a circular orbit within the arcuate chamber. The working volumes within the engine successively expand and contract for inducting fluid through either port, depending upon the direction of gyration, and for exhausting the fluid through the other port.

5 Claims, 8 Drawing Figures

ORBITAL PISTON ENGINE

CROSS-REFERENCE TO RELATED APPLICATION

This application is a continuation-in-part of application Ser. No. 504,437 filed Sept. 9, 1974, now abandoned.

BACKGROUND OF THE INVENTION

This invention relates in general to engines for use as fluid pumps and motors, and in particular relates to engines of the type that employ pistons which orbit within working chambers for creating expanding and contracting volumes.

Engines of the type described have previously been proposed in which a piston element is mounted between a pair of eccentrics for movement within a working chamber. In one prior design the eccentrics counter-rotate so that the piston undergoes a wobble motion, while in another design the eccentrics rotate conjointly so that the piston moves in a circular orbit. However, such prior art engines have a number of drawbacks and limitations. Thus, in certain of the engines separate independently movable seal elements are required with a resulting increase in complexity, cost of construction, wear and maintenance problems. In other prior art designs the piston is of circular configuration with the eccentrics engaging the piston at diametrically opposed positions. In an engine of such a design, however, the size of the working volume is relatively restricted inasmuch as the radial width of the piston must be as large as the connection to the eccentric. In addition, such prior art engine designs do not achieve efficient fluid flow because of their inability to form complete seals between the fluid volumes.

Objects and Summary of the Invention

It is a general object of the invention to provide an engine of the type employing an oribital piston. The present engine is relatively simple and inexpensive in design and construction, provides more effective sealing of the working chambers, and has a relatively large volumetric flow capacity in comparison to existing engines of this type.

Another object is to provide an engine of the type described which incorporates an orbital piston creating expanding and contracting volumes with continuous and non-pulsating flow when used as a pump, or with continuous and non-pulsating torque when used as a motor.

Another object is to provide an engine of the type described which provides for complete sealing between separate fluid volumes within the working chamber of the engine.

Another object is to provide an engine of the type described which employs an elongate orbital piston mounted for movement within an elongate working chamber whereby a large fluid flow capacity is achieved in relation to the overall size of the engine.

Another object is to provide an engine of the type described in which the piston is formed with flutes which form sealing edges and which transfer fluid-carried foreign matter across the working chamber.

The engine of the invention includes a housing which defines a crescent-shaped working chamber within which a similar crescent-shaped piston is mounted. The working chamber includes a pair of juxtaposed cylindrical chambers which are interconnected by an arcuate chamber, with inlet and outlet ports being formed through the housing into the cylindrical chambers. The piston is formed with a pair of crank ends that are interconnected by an arcuate mid-span which serves as the principal displacement element. The walls of the chamber and piston co-operate in a manner to create seals between the inducting and exhausting fluid volumes within the engine. A drive mechanism is provided for conjointly turning a pair of eccentrics connected with the crank ends to gyrate the piston in a circular orbit for creating the expanding and contracting volumes. Recesses are formed in the cylindrical chamber for preventing hydraulic lock-up and vacuum formation within the chambers. In another embodiment flutes are formed along the piston for passing fluid-carried foreign matter. In another embodiment the sides of the chamber and piston are elongate for a large flow capacity.

The foregoing and additional objects and features of the invention will become apparent from the following description in which the preferred embodiment has been set forth in detail in conjunction with the acccompanying drawings.

DESCRIPTION OF THE PREFERRED EMBODIMENTS

Figure 1:
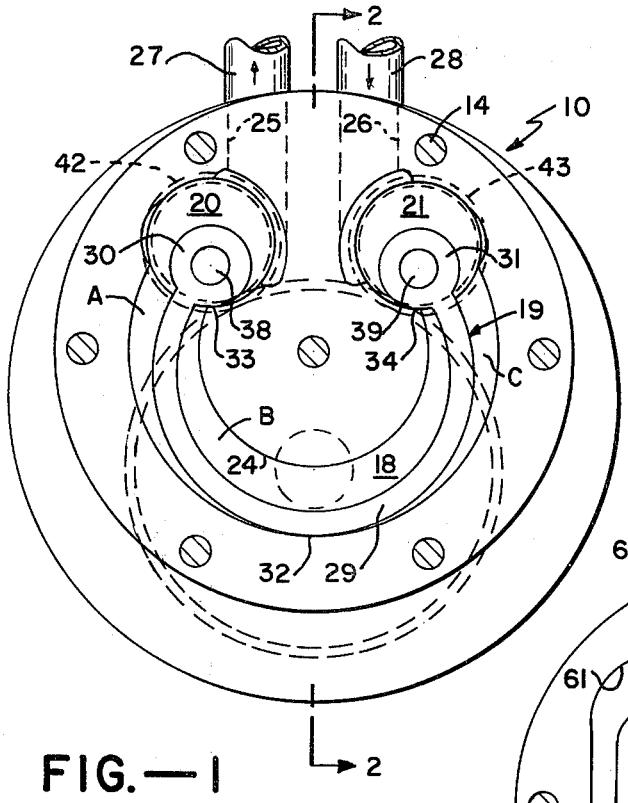
FIG. 1 is a cross-sectional view of an orbital piston engine incorporating the invention and showing the piston in one operation position.
Figure 6:
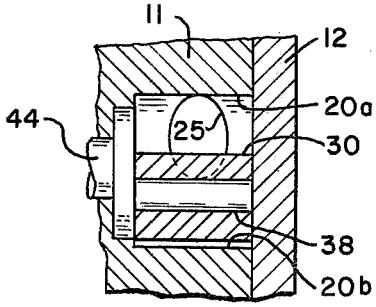
FIG. 6 is a fragmentary cross-sectional view taken along the line 6—6 of FIG. 1.
Figure 2:
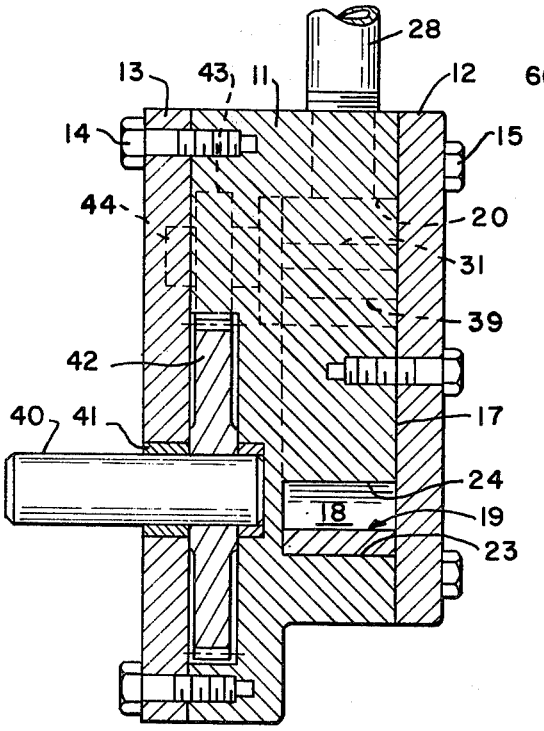
FIG. 2 is an axial sectional view taken along the line 2—2 of FIG. 1.

In the drawings FIG. 1 illustrates an orbital piston engine 10 constructed in accordance with the invention. Engine 10 will be described for use as a fluid pump in which mechanical power is used to transfer a fluid through an open or closed circuit, or to transfer power such as by pressurizing hydraulic fluid for operating a fluid motor. The invention also contemplates that engine 10 can be used as a fluid motor in which fluid under pressure is converted into mechanical power or as a metering device.

Engine 10 includes a three element housing comprising cylinder block 11 to which front and rear end covers 12, 13 are secured by suitable means such as the machine bolts 14, 15. The front side 17 of the cylinder block is grooved to form a working chamber 18 in which an arcuate piston 19 is mounted for gyrating movement. Working chamber 18 is formed in an arcuate or crescent shape and is interconnected with and diverges outwardly from a pair of spaced cylindrical chambers 20, 21. The radial outer and inner walls of the working chamber are defined by spaced surfaces 23 and 24 which extend along an arc of substantially 270° as measured between the centers of the cylindrical chambers.

Ports 25 and 26 are formed through the top of cylinder block 11 and extend into respective cylindrical chambers 20, 21 for directing the working fluid medium into and out of engine. Conduits 27 and 28 are provided for connecting the ports with the particular fluid circuit in which the engine is employed. Engine 10 is reversible in operation so that the ports serve as either inlet or outlet ports, depending upon the direction of operation of the engine elements.

The cylindrical chambers 20 and 21 are formed with respective recesses 20*a* and 21*a* at the juncture with the ports, together with smaller recesses 20*b* and 21*b* on diametrically opposite sides of the chambers. These recesses provide space for fluid to communicate between the crank ends and chamber walls, thereby avoiding fluid lock-up and vacuum conditions within trapped volumes which would otherwise be formed in the chambers.

Piston 19 is formed with an arcuate mid-span 29, which interconnects a pair of enlarged, space-apart crank ends 30, 31 mounted within respective cylindrical chambers 20, and 21. Arcuate mid-span 29 serves as the principal fluid displacement element, with additional fluid displacement being provided by the crank ends. In the illustrated embodiment piston 19 extends along an arc of substantially 270°, as measured from the centers of the crank ends.

Figure 3:
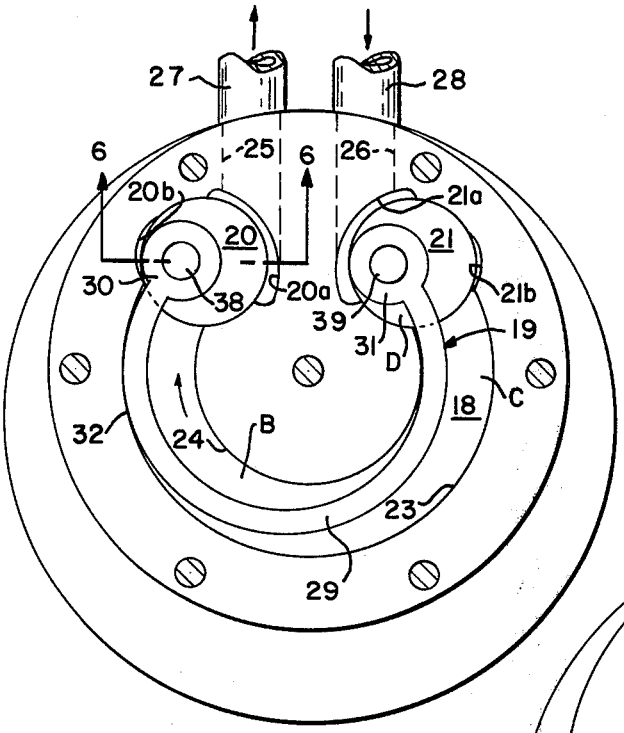
FIG. 3 is a view similar to FIG. 1 showing the piston in another operative position.
Figure 4:
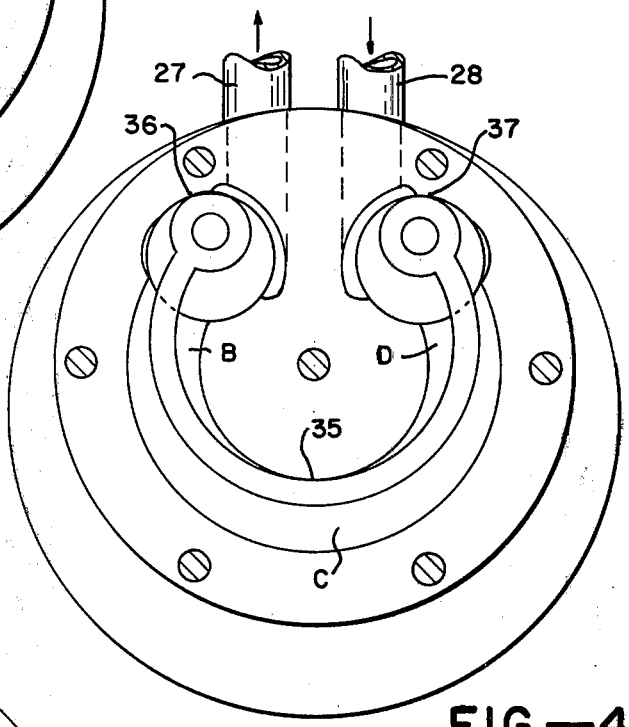
FIG. 4 is a view similar to FIG. 1 showing the piston in another operative position.
Figure 5:
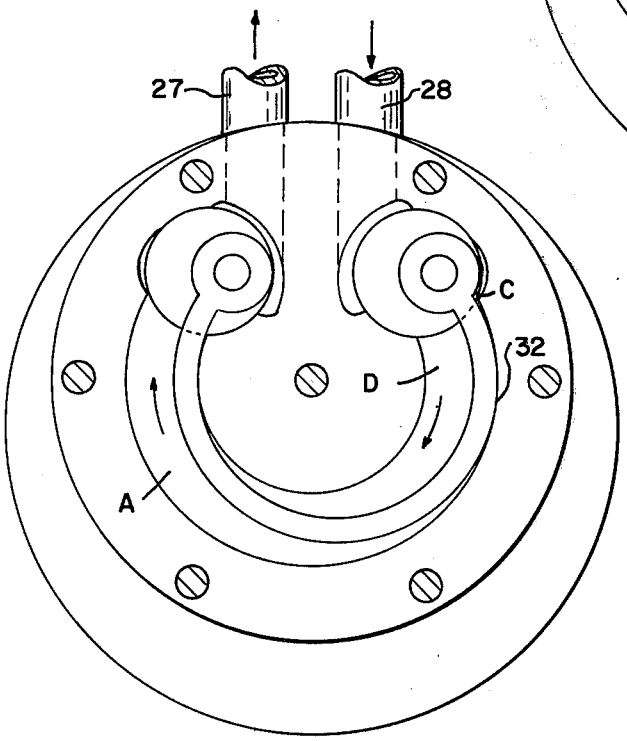
FIG. 5 is a view similar to FIG. 1 showing the piston in still another operative position.

The enlarged piston crank ends cooperate with the enlarged cylindrical chambers 20 and 21 to achieve fluid sealing at all times between the inducting and exhausting volumes which are undergoing expansion or compression. Without such sealing efficiency would be compromised because the piston midspan itself provides sealing across the junctures between working chamber 18 and the cylindrical chambers during only about 300° arc of piston rotation. Sealing for substantially the remaining arc of rotation is provided by the contact between the crank ends and chamber walls which separate the recesses formed in the cylindrical chambers. Thus, with the piston as shown in FIG. 1 the outer line of piston tangency 32 forms a seal between fluid volumes A and C, which are open to respective ports 25 and 26, while at the same time the lines of contact 33 and 34 between the crank ends and chamber walls provide seals between volume B and volumes A and C. With the piston as shown in FIG. 3 the inner line of piston tangency 35 provides sealing between volumes B and D, while outer line 32 provides sealing between volumes C and B. With the piston as shown in FIG. 4 inner line 35 continues sealing between B and D while crank end contact lines 36 and 37 provide sealing between volume C and the two ports. With the piston as shown in FIG. 5 inner line 35 provides sealing between D and port 25 while outer line 32 provides sealing between C and port 26.

Operating means is provided for constraining the piston for movement in a circular orbit within the working chamber. The operating means includes a pair of eccentrics 38, 39 which are mounted in circular recesses formed in the cylinder block at the base of respective cylindrical chambers 20, 21. The eccentrics are mounted for rotation about axes concentric with the respective cylindrical chambers, and are rotatably connected to the crank ends of the piston about axes which are parallel with and spaced from the chamber axes. A drive mechanism is provided for operating the eccentrics in conjoint rotation. Preferably the drive mechanism comprises a drive shaft 40 which is rotatably supported through rear end cover 13 by a bearing 41. A pinion gear 42 is keyed on the drive shaft, and a pair of driven gears 42, 43 are provided within cylinder block 11 in meshing engagement with the pinion gear. The driven gears in turn are keyed to stub shafts 44 which are integral with and project rearwardly from the eccentrics. Where engine 10 is used as a pump, shaft 40 and the pinion gear are driven from a suitable power source such as an electric motor, and where the engine is used as a motor the drive shaft is coupled to a suitable drive train, not shown, for delivering mechanical power to the desired end use application.

When drive shaft 40 is driven counter-clockwise, as viewed in FIG. 1, the two driven gears are turned in illustrated clockwise direction. This moves the crank ends, and thereby the piston mid-span, in a clockwise circular orbit. The outer diameters of the crank ends are sized in relation to the inner diameters of cylindrical chambers 20, 21 and the crank throw eccentricity so that the outer circular walls of the crank ends move in tangential, sealing relationship with the chamber walls.

In explaining the operation of the invention, it will be assumed that engine 10 is used for pumping a fluid such as hydraulic oil. Conduit 28 is connected as an inlet to a suitable fluid reservoir, not shown, and conduit 27 is connected as an outlet through suitable conduits in a circuit to the desired end use application. The pump is activated by powering input shaft 40 and pinion gear 42 in turn counter-clockwise, as viewed in FIG. 1. The two eccentrics 38, 39 are thereby conjointly driven clockwise by gears 42 and 43 to gyrate the piston through a clockwise circular orbit.

The intake phase of a cycle of operation for the emerging chamber volume C on the radially outer side of the piston substantially begins when the two crank ends are at the three o'clock positions within their respective chambers, as illustrated in FIG. 5. In this position the outer line of tangency 32 is initially established between the piston and chamber wall 23. Continued clockwise orbiting of the piston toward the six o'clock position of FIG. 1 moves the outer line of tangency clockwise. This causes the outer volumes A and C which lead and trail the line 32 to respectively contract and expand. Fluid is inducted through inlet port 26 into the expanding volume C and is expelled under pressure through outlet port 25 from the contracting volume A. Further movement of the piston to its nine o'clock position of FIG. 3 completely contracts volume A so that substantially all of its contained fluid is exhausted. At the same time, the volume C is approaching the close of its intake phase. Continued movement of the piston toward the twelve o'clock position of FIG. 4 completes the intake phase of volume C, which thereafter is initially opened to exhaust port 25 as crank end 30 separates from the chamber wall and the outer contact line 36 is lost. Movement of the piston through the next quadrant toward the three o'clock position contracts this volume C to initiate its exhaust phase as a new outer line of tangency is created on the right side for a repeat of the cycle.

Initiation of the intake phase of a cycle of operation for the volume D on the radially inward side of the piston substantially begins with the piston at its nine o'clock position of FIG. 3. In this position the inner line of tangency 35 is initially established between the piston and chamber wall 24. Movement of the piston toward the twelve o'clock position of FIG. 4 moves inner line 35 clockwise so that the volume D which trails the tangency line is expanding for inducting fluid while the leading volume B is contracting for exhausting fluid. Continued movement of the piston toward its three o'clock position of FIG. 5 causes the tangency line to progress toward the left, thereby further expanding volume D through its induction stroke while contracting and exhausting volume B through outlet port 25. Continued movement of the piston toward its six o'clock position of FIG. 1 completes the intake phase of the volume B with crank and contact lines 33 and 34 being established for sealing this volume. Further movement of the piston toward its nine o'clock position of FIG. 3 begins the exhaust phase of volume B as contact line 33 is lost and the volume is opened to outlet port 25. Thereafter as the volume B is contracting for its exahaust phase, the line of contact 36 is established with crank end 30 (FIG. 4) thereby precluding backflow of outlet fluid around the crank end. Similarly, backflow of fluid exhausting from the volume C on the outer side of the piston during its exhaust phase is precluded due to the seal that is established by the line of contact 37 with crank end 31.

Figure 7:
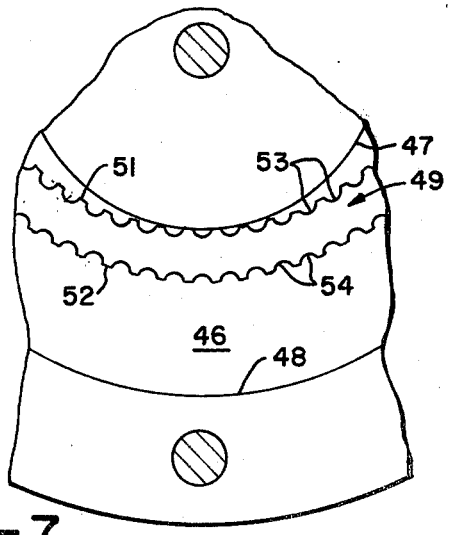
FIG. 7 is a fragmentary view, similar to FIG. 4, to an enlarged scale of another embodiment of the invention.

FIG. 7 illustrates another embodiment of the engine incorporating an arcuate chamber 46 confined between radially spaced walls 47 and 48. An arcuate piston 49 is mounted within this chamber. In the figure a portion of mid-span of the piston is shown in a position at which it is in tangential contact with the inner wall 47 of the chamber. Piston 49 is formed with a crescent configuration and is connected through integral crank ends and a pair of eccentrics, not shown, for orbital movement within the chamber in a manner similar to that described for the embodiment of FIGS. 1–6. The inner and outer radially spaced walls 51 and 52 of the piston mid-span are formed with a plurality of axially extending flutes or recesses 53, 54 which are spaced circumferentially along the piston walls.

Preferably the flutes 53, 54 are formed with axially extending cylindrical configurations such that the juncture between the surfaces of the flutes and the piston walls 51, 52 define angular edges which move tangentially across the chamber walls 47, 48. Foreign matter which is carried in the fluid, such as grit or other solid particles, is thereby carried within the volumes of the flutes and transferred across the chamber from the inlet to the discharge port. This serves to minimize wear and erosion or other damage between the walls of the piston and annular chamber.

Preferably the cross-sectional shape of the flutes is at least a semi-circle so that the included angle between the recess surface and the piston wall at each of the edges is 90° or less. This creates a relatively sharp edge which has some flexibility, and this flexibility is enhanced where the piston is fabricated from a suitable plastic material, such as a synthetic polymer. The capability of the flute edges to flex and deform results in these edges acting as a fluid seal against the walls of the annular chamber. In addition, dimensional problems due to thermal expansion and contraction during operation are minimized, and the requirement of maintaining close tolerances is also minimized. The flexing characteristic of the flute edges also permits the piston to be assembled with a small interference fit with the chamber walls. As a result the elements of the engine may be inexpensively constructed of synthetic polymer materials by conventional injection molding processes.

Figure 8:
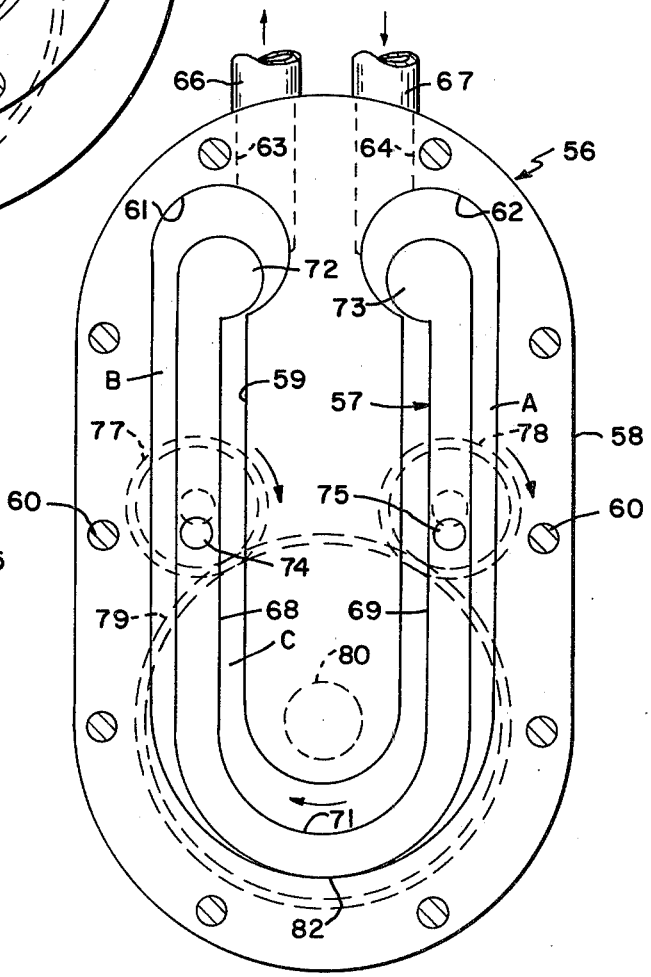
FIG. 8 is a cross-sectional view of another embodiment of the invention.

FIG. 8 illustrates an embodiment incorporating an orbital piston engine 56 having an elongated piston element 57 which provides increased fluid flow capacity in relation to its overall size. Engine 56 comprises a cylinder block 58 which is formed with an elongate U-shaped channel 59 defining a working chamber for the fluid. An end plate, not shown, is secured to the end of block 58 over the channel by bolts 60. The two upper ends of the channel are enlarged to form cylindrical chambers 61, 62, and respective ports 63, 63 formed through the upper end of the cylinder block open into the cylindrical chambers. A pair of conduits 66, 67 are connected to respective ports for inlet and outlet functions.

Piston 57 is formed with a pair of elongate side portions 68, 69 which are joined at their lower ends by a circular portion 71 and which terminate at their upper ends with circular knobs 72, 73. The piston knobs are sized to orbit in sealing relationship against the inner walls of chambers 61 and 62. The outer walls of the piston sides, as well as the outer walls of the elongate portions of channel 59, and are streamlined into the walls of respective piston knobs and the cylindrical chambers. This streamlining eliminates the requirement for forming recesses in the cylindrical chambers in that trapped volumes are not formed between the knobs and chamber walls.

Piston 57 is orbited by drive means comprising a pair of eccentric cranks 74, 75 which are journaled for rotation within the back side of cylinder block 58. The cranks are rotatably connected with the mid-spans of respective piston side portions 68 and 69. The cranks are keyed for rotation with respective gears 77, 78 which are in meshing engagement with a drive gear 79 rotatably mounted by axle 80 to the cylinder block. The drive gear in turn is coupled with a suitable power source, where engine 56 is used as a pump or compressor, or with a drive train for delivering mechanical power where used as a motor.

In operation, assume that engine 56 is to be used as a fluid pump. Conduit 67 is connected to the source of fluid while conduit 66 is connected to the circuit which is to be pressurized. Gear 79 is powered to turn counter-clockwise, as viewed in FIG. 8, which drives gears 77 and 78 clockwise. The driven gears thereby move piston 57 in a circular orbit within channel 59. In the piston position shown in FIG. 8, volume A is expanding to induct fluid through port 64 while volume B is contracting to force fluid out of port 63 under pressure. Volumes A and B are separated by tangential sealing contact line 82. Volume C on the inside of the piston has just completed its intake phase and is separated from the intake port and Volume A by the contact lines formed between piston knob 73 and cylindrical chamber 62. Continued rotation of the piston expands and contracts the volumes in a manner similar to that described for the embodiment of FIGS. 1–6. The volume of fluid inducted and exhausted for each orbit of the piston is equal to the volume of the working chamber which is unoccupied by the piston. Because this unoccupied volume is relatively large for this embodiment in comparison to overall engine size, the resulting flow capacity is large.

From the foregoing it will be realized that there has been provided a new and improved orbital piston engine adaptable for use as either a fluid pump or motor. The engine is characterized in providing a simple circular orbit piston mostion within the working chamber without the requirement of inlet and outlet valves. The orbital motion of the piston creates expanding and contracting volumes in a manner to achieve continuous and non-pulsating flow when used as a pump, or continuous and non-pulsating torque when used as a motor. The porting arrangement expells substantially all fluid from the working chamber during the exhaust stroke so that fluid pooling is eliminated.

While the foregoing embodiments are at present considered to be preferred it is understood that numerous variations and modifications may be made therein by those skilled in the art and it is intended to cover in the appended claims all such variations and modifications as fall within the true spirit and scope of the invention.

I claim:

1. In an engine for use as a fluid pump or motor, including the combination of a housing, means forming a working chamber within the housing, said chamber including a pair of juxtaposed cylindrical chambers and an arcuate chamber interconnecting with and extending outwardly from the cylindrical chambers, means forming inlet and outlet ports through the housing in fluid communication with respective cylindrical chambers, a piston mounted for movement in a circular orbit in the working chamber, the piston including a pair of enlarged ends and an arcuate mid-span carried by the enlarged ends, said arcuate mid-span being sized to sucessively form lines of sealing contact with the walls of the arcuate chamber for separating fluid volumes therein, said enlarged ends being formed with outer contours having radii greater than the radial width of the mid-span and less than the radii of the cylindrical chambers for forming lines of sealing contact with the walls of the cylindrical chambers for separating the fluid volumes on opposite sides of the piston, and operating means for constraining said piston for conjoint circular movement within said working chambers for expanding and contracting said volumes whereby fluid is inducted through one of said ports, advanced through the engine in a substantially non-pulsating flow and exhausted through the other of the ports.

2. An engine as in claim 1 for use as a fluid pump in which said operating means moves the enlarged ends in circular paths whereby gyration of the piston inducts fluid through one of the ports and exhausts the fluid under pressure through the other ports.

3. An engine as in claim 1 for use as a fluid motor which includes means to direct fluid under pressure through one of said ports for acting in the expanding volumes to impart a driving force on the piston for causing the same to gyrate in a circular path within the chamber.

4. An engine as in claim 1 in which the cylindrical chambers are each formed with a circular peripheral wall, the piston enlarged ends are each formed with a circular outer wall and said operating means constrains the enlarged ends for movement along a circular path whereby the outer walls of the enlarged ends move in tangential sealing relationship with the walls of the cylindrical chambers as the piston moves through a phase of the cycle of operation.

5. An engine as in claim 4 in which recess means is formed in the walls of the cylindrical chamber for communicating fluid to between the enlarged ends and chamber walls to preclude fluid lock-up and vacuum formation therebetween.

* * * * *